US009765741B2

(12) United States Patent
Schulz et al.

(10) Patent No.: US 9,765,741 B2
(45) Date of Patent: Sep. 19, 2017

(54) COMMON-RAIL-SYSTEM

(71) Applicant: KENDRION (Villingen) GmbH, Villingen-Schwenningen (DE)

(72) Inventors: Florian Schulz, Brigachtal (DE); Gerd Strobel, Villingen-Schwenningen (DE); Wolfgang Knoebel, Donaueschingen (DE)

(73) Assignee: Kendrion (Villingen) GmbH, Villingen-Schwenningen (DE)

( * ) Notice: Subject to any disclaimer, the term of this patent is extended or adjusted under 35 U.S.C. 154(b) by 0 days.

(21) Appl. No.: 14/412,095

(22) PCT Filed: Aug. 14, 2013

(86) PCT No.: PCT/EP2013/067020

§ 371 (c)(1),
(2) Date: Dec. 30, 2014

(87) PCT Pub. No.: WO2014/029676

PCT Pub. Date: Feb. 27, 2014

(65) Prior Publication Data

US 2015/0167611 A1 Jun. 18, 2015

(30) Foreign Application Priority Data

Aug. 23, 2012 (DE) ..... 10 2012 107 764

(51) Int. Cl.
*F02M 63/02* (2006.01)
*F02M 59/36* (2006.01)

(52) U.S. Cl.
CPC ..... *F02M 63/0265* (2013.01); *F02M 59/366* (2013.01); *F02M 59/368* (2013.01); *F02M 63/023* (2013.01)

(58) Field of Classification Search
CPC ... F02M 63/023; F02M 59/366; F02M 59/368
See application file for complete search history.

(56) References Cited

U.S. PATENT DOCUMENTS 5,135,027 A * 8/1992 Miki ..... F16K 31/0631 137/596.17
2006/0289822 A1* 12/2006 Kleinert ..... H01F 7/1607 251/129.15

(Continued)

FOREIGN PATENT DOCUMENTS

CN 101490397 A 7/2009
DE 40 41 377 A1 12/1990

(Continued)

OTHER PUBLICATIONS

International Search Report dated Oct. 21, 2013 for parent application PCT/.

(Continued)

*Primary Examiner* — Jacob Amick
(74) *Attorney, Agent, or Firm* — Juneau & Mitchell

(57) ABSTRACT

The invention relates to a common rail system for an internal combustion engine of a vehicle, comprising a high-pressure pump which delivers highly pressurized fuel to a high-pressure accumulator, from which the fuel is fed to at least one injection valve of the internal combustion engine, a low-pressure pump for conveying fuel from a fuel container via a conveying line to the high-pressure pump, a flow control valve as an electromagnetic switching valve which is arranged in the conveying line for controlling the fuel quantity which is fed by the high-pressure pump to the high-pressure accumulator; it is provided according to the invention that the flow control valve is configured as a ball seat valve with an inlet opening which is connected to the low-pressure pump and an outlet opening which is connected to the high-pressure pump, which ball seat valve is open in the de-energized state.

4 Claims, 2 Drawing Sheets

(56) References Cited

U.S. PATENT DOCUMENTS

| | | | | |
|---|---|---|---|---|
| 2009/0314977 | A1* | 12/2009 | Beck | F16K 31/0675<br>251/129.15 |
| 2010/0294247 | A1* | 11/2010 | Mueller | F02D 41/20<br>123/480 |

FOREIGN PATENT DOCUMENTS

| | | | | |
|---|---|---|---|---|
| DE | 197 27 785 | A1 | 6/1997 | |
| DE | 699 17 552 | T2 | 9/1999 | |
| DE | 102 51 014 | A1 | 11/2002 | |
| DE | 102007028960 | A1 | 6/2007 | |
| EP | 1 348 864 | A1 | 1/2001 | |
| EP | 1 241 338 | A2 | 1/2002 | |
| MC | DE 69917552 | T2 * | 6/2005 | F02M 63/0052 |

OTHER PUBLICATIONS

SIPO office action dated Jun. 13, 2017 for related Chinese application 201380043604.8.

* cited by examiner

COMMON-RAIL-SYSTEM

CROSS REFERENCE TO RELATED APPLICATIONS

This patent application claims priority International Patent Application PCT/EP2013/067020, filed on Aug. 14, 2013, and thereby to German Patent Application 10 2012 107 764.9, filed on Aug. 23, 2012.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The present invention relates to a common rail system for an internal combustion engine of a vehicle.

Background of the Invention

Common rail systems as fuel injection systems are known in prior art, which comprise a high-pressure pump for providing high-pressurized fuel for a high-pressure accumulator (common rail) and a low-pressure pump as a preliminary conveyance pump, which conveys the fuel from a fuel tank via a conveyor line to the high-pressure pump, with the quantity of fuel conveyed by the high-pressure pump to the high-pressure accumulator being controlled by a flow control valve arranged in the conveyor line and the quantity of fuel measured by the flow control valve being impinged by the high-pressure pump with the respectively high pressure.

Such a common rail system CRS is schematically shown in FIG. 4. Accordingly, this common rail system CRS comprises a high-pressure accumulator R, from which injection valves Inj of an internal combustion engine (not shown), for example a diesel engine, are being supplied with fuel.

The high-pressure accumulator R is connected via a high-pressure line L1 to a high-pressure pump HP, which is driven by an electric motor M1. From a fuel tank KB, via a low-pressure pump NP driven by an electric motor M2, fuel is conveyed via a conveyor line L2 to a flow control valve VNC, which is embodied as an electromagnetic switching valve showing the design of a slide valve and which in the un-electrified state is closed ("normally closed"). At the outlet side this slide valve VNC is connected to the high-pressure pump HP.

Finally, a high-pressure control valve HPV connects the high-pressure accumulator R via a pressure release line L3 to the outlet side of the low-pressure pump NP. This high-pressure control valve HPV, embodied as an electromagnetic switching valve, serves for the rapid pressure reduction of the high-pressure accumulator R.

This high-pressure control valve HPV is required here because advantageously the slide valve VNC does not show 100% freedom from leakage. This leakage is caused in the play between this slide element and the valve body required to displace the sliding element. This leads to the circumstance that during the sliding operation fuel enters the high-pressure pump HP and is compressed there, resulting in the pressure increasing in the high-pressure accumulator R if the injectors Inj provide no fuel to the internal combustion engine, thus no consumer is connected to the high-pressure accumulator R. In such operating states the pressure is released via the high-pressure control valve HPV.

Here the flow control valve VNC, the high-pressure and the low-pressure pump HP and NP, respectively, the high-pressure control valve HPV, as well as the injection valves Inj are controlled and/or adjusted by a control device (not shown).

A common rail system according to FIG. 4 is known for example from DE 60 2005 003 427 T2, in which a slide valve is used as the flow control valve, which is closed in the un-electrified state. In order to counteract the disadvantages developing by the use of common slide valves, in addition to the lack of freedom from leakage, namely insufficient centering of the slide element in the valve chamber and the thereby caused lack of ability to glide, which leads to increased wear and tear by high abrasion, an improved design of a slide valve is suggested. This improved design relates to the embodiment of the slide element.

The disadvantage of insufficient freedom from leakage when using a slide valve in a common rail system is eliminated according to DE 198 46 157 A1 such that at the outlet side of the flow control valve both a reflux line is provided leading back to the fuel tank as well as a differential pressure valve is connected here, which is connected to the suction valves of a high-pressure pump. This way it is achieved that the high-pressure pump in the operating state "zero conveyance" abstains from conveying any fuel, because the differential pressure valve cannot be overcome by the leakage flow of the flow control valve.

Another disadvantage of the use of the "normally closed" slide valve in common rail systems is given in the fact that in case of a defect or the failure of such a slide valve no fuel can be conveyed into the rail, thus into the high-pressure accumulator, and thus any further operation of the internal combustion engine is impossible.

The invention is based on the objective to further develop the underlying common rail system according to the type mentioned at the outset such that the disadvantages known from prior art are avoided, particularly a simple design is possible with only few parts.

BRIEF SUMMARY OF THE INVENTION

In a preferred embodiment, a common rail system for an internal combustion engine of a vehicle, comprising:

- a high-pressure pump, which supplies fuel impinged with high pressure to a high-pressure accumulator, from which the fuel is fed via at least one injection valve to the internal combustion engine,
- a low-pressure pump to convey fuel from the fuel tank via a conveyor line to the high-pressure pump,
- a flow control valve as an electromagnetic switching valve, which is arranged in the conveyor line to control the quantity of fuel fed from the high-pressure pump to the high-pressure accumulator, characterized in that the flow control valve is embodied as a ball seat valve with an inlet opening connected to a low-pressure pump and an outlet opening connected to a high-pressure pump, which valve is open in the un-electrified state.

In another preferred embodiment, the common rail system as described herein, wherein the ball seat valve is embodied with a valve seat and a valve ball such that in the un-electrified state of the ball seat valve, by the low-pressure pump applying pressure, the valve ball contacts the valve seat, hereby closing the inlet opening.

In another preferred embodiment, the common rail system as described herein, wherein the ball seat valve is embodied with a pre-stressed spring valve tappet such that in order to open the inlet opening the valve tappet, in the un-electrified state of the ball seat valve, is in an effective connection lifting the valve ball off its valve seat.

In another preferred embodiment, the common rail system as described herein, wherein the ball valve comprises an anchor, which can be displaced in reference to the pole core, which centrally accepts the valve tappet.

In another preferred embodiment, the common rail system as described herein, wherein the pole core comprises a central bore to accept a pressure spring, with at one end the pressure spring being supported at the anchor and at the other end being supported at a closure part of the pole core, closing the bore at a side of the pole core pointing away from the anchor.

In another preferred embodiment, the common rail system as described herein, wherein the anchor is embodied with a decentralized bore, which connects the bore of the pole core with a valve chamber at the side of the valve ball.

DETAILED DESCRIPTION OF THE INVENTION

This common rail system for an internal combustion engine of a vehicle comprises a high-pressure pump, which conveys fuel, impinged with high pressure, to a high-pressure accumulator, from which the fuel is fed by at least one fuel injection valve to an internal combustion engine, further a low-pressure pump to convey fuel from a fuel container via a conveyor line to the high-pressure pump, and finally a flow control valve as an electromagnetic switching valve, which is arranged in the conveyor line for controlling the quantity of fuel fed by the high-pressure pump to the high-pressure accumulator and which is characterized according to the invention in that the flow control valve is embodied as a ball seat valve with an inlet opening, connected to the low-pressure pump, and an outlet opening, connected to the high-pressure pump, which is open in the un-electrified state.

Such a common rail system according to the invention with a ball seat valve, which is open in the un-electrified state ("normally open"), during operation of the internal combustion engine at least leads to no malfunction of the internal combustion engine when said ball seat valve is defective or fails.

Figure 4:
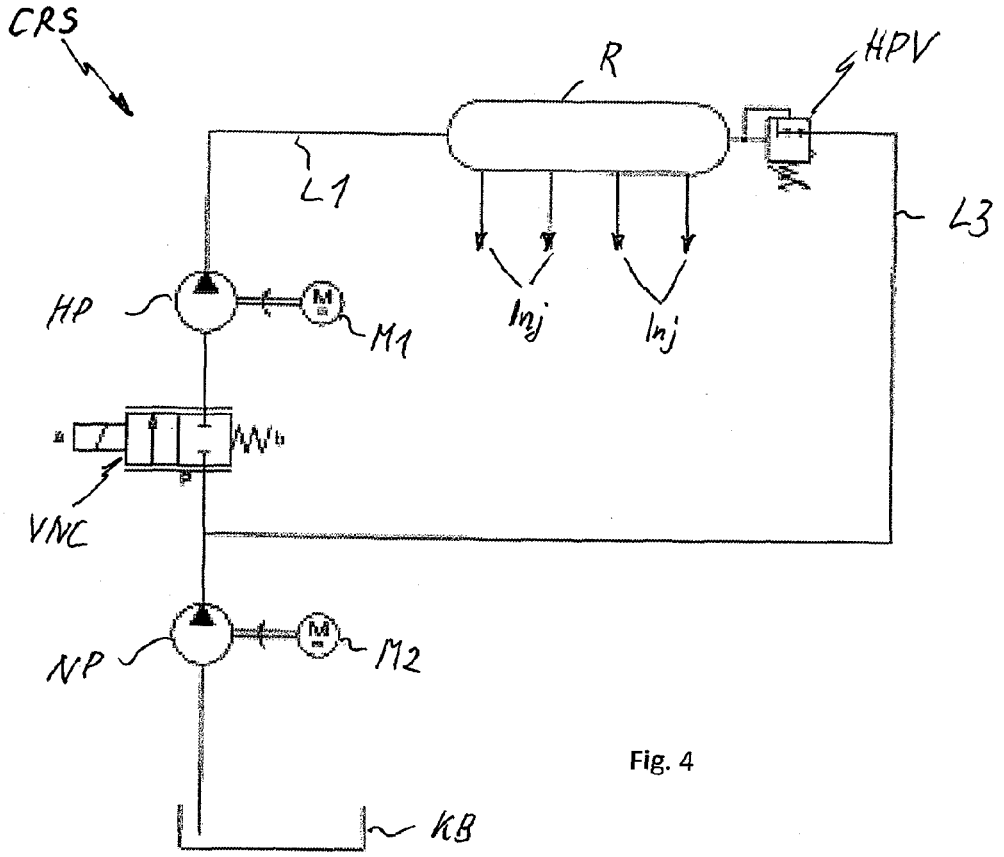
FIG. 4 is a schematic illustration of a common rail system with a slide valve as a flow control valve according to prior art.

Another advantage is given in that such a ball seat valve, being an electromagnetic switching valve, shows no leakage so that in the operating state "zero conveyance" no fuel is conveyed via the high-pressure pump into the high-pressure accumulator. This leads to the fact that the high-pressure valve HPV can be omitted, which is necessary in the common rail system of prior art according to FIG. 4. For technical safety reasons it is sufficient, instead of this high-pressure control valve HPV, to provide only a mechanic pressure valve. This mechanic pressure valve opens only in the event of the "worst case scenario," for example if the ball seat valve was to jam.

This way, in reference to common rail systems of prior art, the number of required components is reduced, however, at least a simpler design is realized with the common rail system according to the invention, because an expensive high-pressure control valve is omitted.

Such ball seat valves, embodied as electromagnetic switching valves which are open in the un-electrified state, are known from DE 40 41 377 A1, for example.

In a further development of the invention the ball seat valve is embodied with a valve seat and a valve ball such that in the electrified state of the ball seat valve, by impingement with pressure from the low-pressure pump, the valve ball contacts the valve seat and thus closes the inlet opening.

Due to the fact that the valve ball contacts at the pressure side and is exclusively pressed against the valve seat by the fluid pressure of the low-pressure pump in the electrified state of the ball seat valve, here any spring elements at the pressure side are omitted and thus no spring tolerances need to be observed and/or adjusted. This leads to a high degree of tightness and thus also ensures a complete freedom from leakage.

In one embodiment of the invention the ball seat valve is embodied with a pre-stressed spring valve tappet such that for opening the inlet opening, in the un-electrified state of the ball seat valve, the valve tappet is in an effective connection with the valve ball, lifting it off its valve seat. Preferably the ball seat valve comprises an anchor, displaceable in reference to a pole core, which centrally accepts the valve tappet. This way the anchor, accepting the valve tappet, acts opposite the pressure spring, located at the un-pressurized side.

This leads to a mechanic decoupling of the anchor and/or the valve tappet and the valve ball, further reducing the stress of the anchor and the valve tappet under vibrations.

According to another embodiment of the invention the pole core comprises a central bore to accept a pressure spring, with on the one side the pressure spring being supported at the anchor and on the other side supported on a closure part of the pole core closing the bore at the side of the pole core pointing away from the anchor.

With such a closure part, which is either inserted via a press fit or a screwed connection into the bore of the pole core, depending on the depth of penetration of the closure part in the pole core, the spring force of the pressure spring acting upon the valve tappet can be adjusted.

Finally, according to a final embodiment of the invention it is provided that the anchor is embodied with a decentralized bore, which connects the bore of the pole core to a valve chamber at the side of the valve ball. This way a pressure compensation of the two chambers is achieved via this decentralized bore of the anchor and thus any pressure pulses are prevented, and a homogenous filling of the operating chambers of the high-pressure pump is possible.

DETAILED DESCRIPTION OF THE FIGURES

Figure 1:
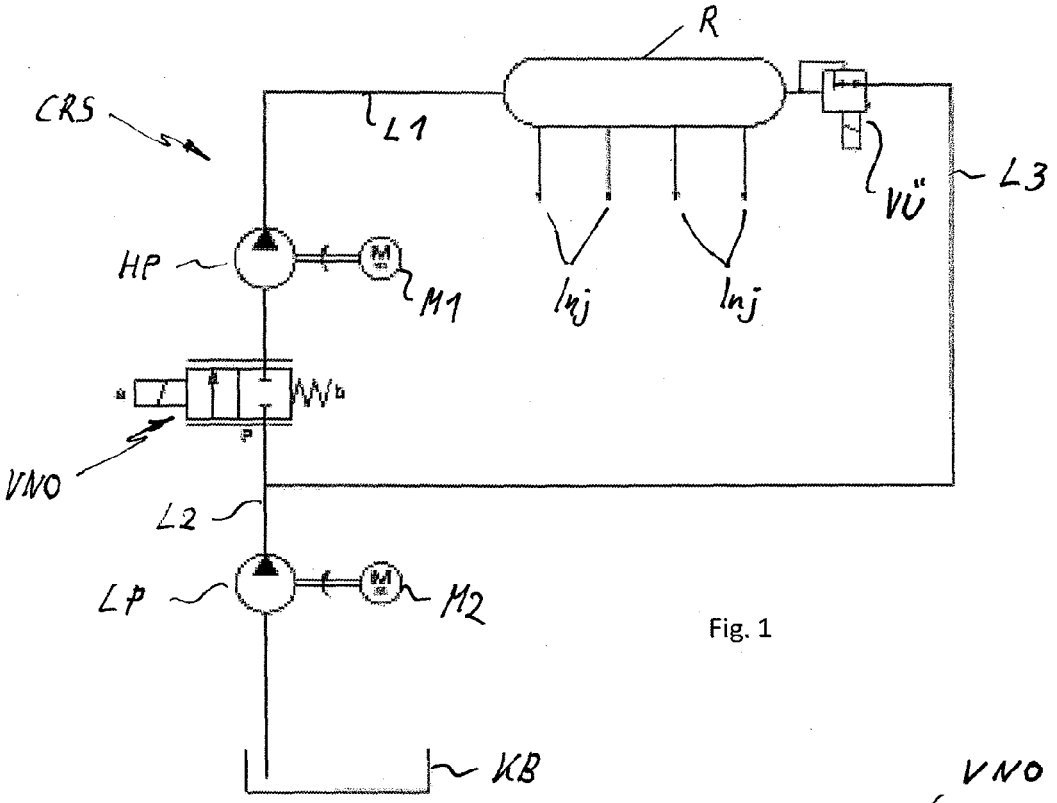
FIG. 1 is a schematic illustration of a common rail system with a ball seat valve as the flow control valve according to an embodiment of the invention.

The common rail system CRS according to FIG. 1 comprises a high-pressure accumulator R with fuel impinged with high-pressure, which is fed by injectors Inj to an internal combustion engine (not shown).

The high-pressure accumulator R is connected via a high-pressure line L1 to a high-pressure pump HP, which is driven by an electric motor M1.

A low-pressure pump NP, driven by an electric motor M2, conveys fuel from a fuel tank KB, which is supplied via a conveyor line L2 of the high-pressure pump HP, with in this conveyor line L2 a ball seat valve VNO being arranged as a flow control valve, which as an electromagnetic switching valve is open in the un-electrified state.

The quantity of fuel, which is supplied by the high-pressure pump HP to the high-pressure accumulator R, is controlled via this ball seat valve VNO.

Finally, the high-pressure accumulator R is connected via a mechanic overpressure valve VÜ and a pressure release line L3 to the conveyor line L2 between the low-pressure pump NP and the ball seat valve VNO. This overpressure valve VÜ is only required for reasons of technical safety, in order to allow releasing excess pressure in the high-pressure accumulator R in the "worst case scenario."

Finally, this common ball system CRS according to FIG. 1 also comprises a control device (not shown), which controls the low-pressure pump NP, the high-pressure pump HP, the ball seat valve VNO, and the injectors Inj via control lines (not shown) depending on the sensor signals and the operating state of the internal combustion engine.

This common rail system CRS according to the invention is characterized by the use of a ball seat valve VNO as a flow control valve, which in the un-electrified state is open and controls the volume flow of the fuel fed to the high-pressure pump HP.

Due to the fact that such a ball seat valve VNO is free from leakage, during the operating state "zero conveyance" no fuel is supplied by the ball seat valve VNO to the high-pressure pump HP. Accordingly, a high-pressure control valve HPV, as required in prior art according to FIG. 4, can be waived in the common rail system CRS according to the invention and shown in FIG. 1. For reasons of technical safety only a mechanic pressure valve VÜ is provided, which can generate a connection between the high-pressure accumulator R and the conveyor line L2 between the low-pressure pump NP and the ball seat valve VNO.

In the idle state, thus in the un-electrified state, the ball seat valve VNO is open, so that in case of a defect or in case of a failure of this ball seat valve VNO, in spite of the low-pressure pump NP, fuel can be conveyed to the high-pressure pump so that at least any malfunction regarding the internal combustion engine can be excluded.

Figure 2:
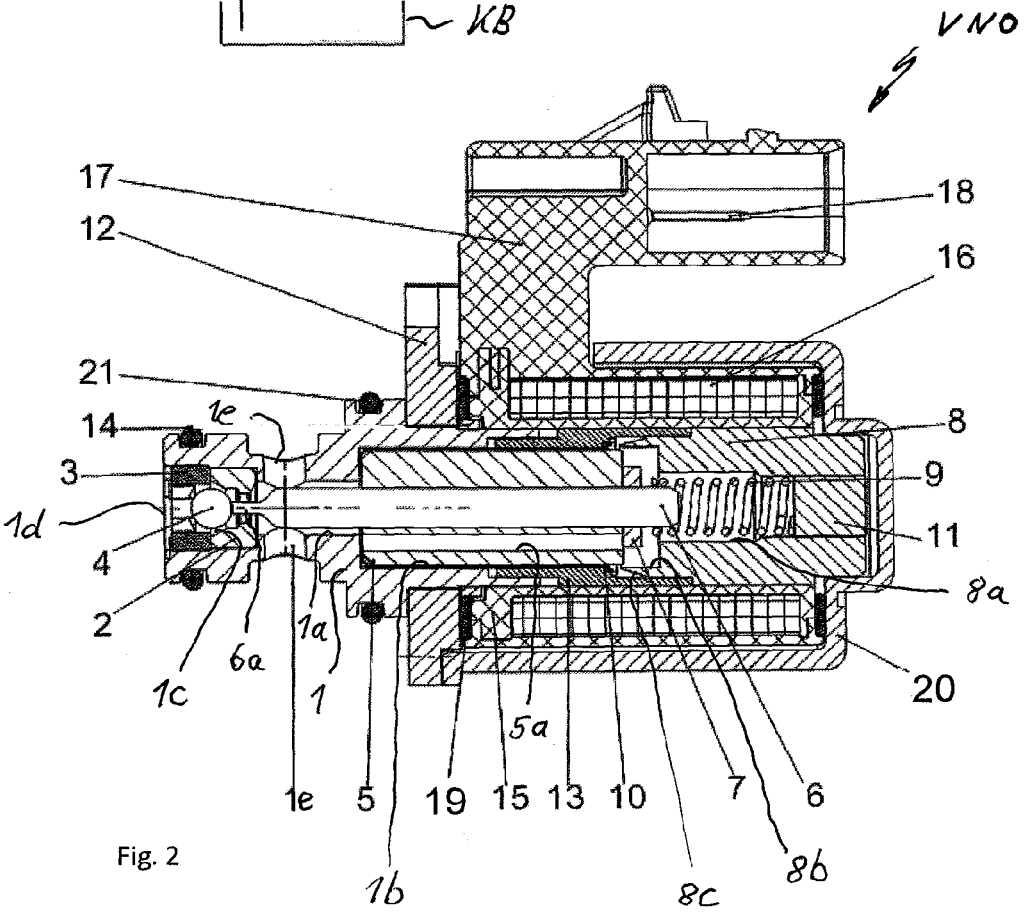
FIG. 2 is an axial longitudinal cross-section of the ball seat valve of the common rail system according to FIG. 1.

Such a ball seat valve VNO is shown in FIG. 2, which accepts a centrally supported pole core 8 in a valve housing 20, partially enclosed by an annular coil, comprising a coil winding 16 arranged on a bobbin 15.

A valve body 1 follows via a connection ring 13 on the pole core 8 comprising a central bore 1*a*, which forms a central accepting chamber 1*b* for an anchor 5 at the side of the pole core. The anchor 5 carries centrally a valve tappet 6, which projects at the side of the pole core beyond the face of the anchor 5 and penetrates into a central bore 8*a* of the pole core 8. This bore 8*a* is closed at the end side by a closure 11, with a pressure spring 9 arranged in the bore 8*a* of the pole core 8 on the one side being supported at this closure 11 and on the other side on the neighboring face of the anchor 5 via a flat spring 7 abutting there.

The bore 8*a* of the pole core 8 transfers at the anchor side into an off-set, cylindrical bore 8*b*, with its diameter being equivalent to the diameter of the anchor 5, so that the anchor 5, upon electrifying the coil winding 16, is pulled into this bore 8*b* of the pole core 8 against the spring force of the pre-stressed pressure spring 9 towards the pole area of the pole core 8. The ring 8*c* surrounding this cylindrical bore is embodied as a control cone with an exterior cone, which serves to adjust the magnetic force-stroke characteristic when the anchor 5 is pulled out of its idle position, according to the position shown in FIG. 2, in the direction towards the pole area of the pole core 8 by electrifying the coil winding 16.

The anchor 5 is accepted by a sheath 10, which extends via the area of the bore 1*b* and the connection ring 13.

The bore 1*a* of the valve body 1 extends at the side of the anchor 5 facing away from the pole core up to a valve chamber 1*c* and converts at the end side into an inlet opening 1*d*, which is connected to the low-pressure pump NP.

The valve chamber 1*c*, following this inlet opening 1*d*, accepts a ball cage 3 to accept a valve ball 4 and a following valve seat 2 for the valve ball 4.

In an area of the central bore 1*a* of the valve body 1, following the valve chamber 1*c*, at least two diametrically opposite radial bores 1*e* are provided as outlet openings 1*e*, which are guided to the high-pressure pump HP.

Starting at the face of the anchor 5 pointing away from the pole core, the valve tappet 6 shows such a length that in the idle position of the ball seat valve VNO shown in FIG. 2, thus in the un-electrified state, the pressure spring 9 pushes the anchor 5 completely into the bore 1*b* of the valve body 1 in the direction towards the inlet opening 1*d* and here the valve tappet 6 with a needle tip 6*a* lifts the valve ball 4 off the valve seat 2 so that the passage between the inlet opening 1*d* and the outlet opening 1*e* is released.

The anchor 5 comprises a non-centric bore 5*a*, extending parallel in reference to the longitudinal axis, which connects its two facial areas. This way the valve chamber 1*c* and the outlet opening 1*e* are connected to the bore 8*a* of the pole core 8 so that a pressure compensation can occur between these chambers during the operation of the ball seat valve VNO and/or no pressure difference develops between these chambers.

In order to assembly the ball seat valve VNO a flange 12 is provided for example at the high-pressure pump HP. In an appropriate connection, O-rings 14 and 21 of the valve body 1 are provided as sealing rings. The coil body 16 is coated to form a plastic body 17 accepting a connection plug 18, with a sealing disk 19 generating the seal in reference to the environment.

If based on the idle position of the ball seat valve VCO according to FIG. 2 the coil winding 16 is electrified, the anchor 5 with the valve tappet 6 is pulled in the direction towards the pole core 8 against the spring force of the pressure spring 9 so that based on the pressure at the inlet side the valve ball 4 is pressed into the valve seat 2 and thus the ball seat valve VNO is closed.

During the assembly of the ball seat valve VNO, an adjustment of the spring force of the pressure spring 9 can occur, by which the anchor 5 is pre-stressed. This way the closure 11, closing the bore 8*a* of the pole core 8 at the end, can be inserted differently deep into the bore 8*a* or can be embodied with different lengths, so that here different long installations can be realized for the pressure spring 9. A press-fit or also a threaded connection may be provided in order to insert the closure 11 into the bore 8*a*.

By different disk springs 7 here easily a stroke adjustment of the anchor 5 can be realized.

Figure 3:
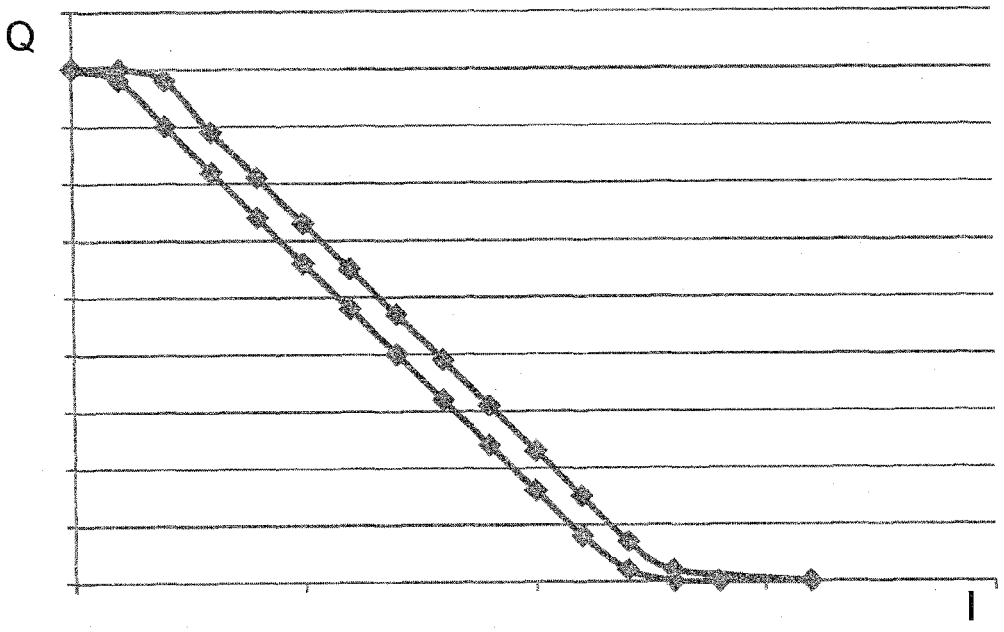
FIG. 3 is a line graph providing a schematic characteristic of the ball seat valve according to FIG. 2.

FIG. 3 shows a schematic characteristic of the ball seat valve VNO according to FIG. 2, which illustrates the volume flow Q depending on the current I. In the un-electrified state and/or at low currents, a high flow rate and/or volume flow of fluid, thus fuel is achieved, which with increasing electrification, thus rising current reduces to the value zero, i.e. until the ball seat valve VNO is closed. The characteristic doubles in the central range due to hysteresis features of the electromagnet.

LIST OF REFERENCE NUMBERS

1 valve body
1*a* central bore of the valve body 1
1*b* accepting chamber of the valve body 1
1*c* valve chamber
1*d* inlet opening
1*e* outlet opening
2 valve seat
3 ball cage
4 valve ball
5 anchor
5*a* decentralized bore of the anchor 5
6 valve tappet
7 spring plate
8 pole core
8*a* bore of the pole core 8
8*b* bore of the pole core 8
8*c* control cone of the pole core 8
9 pressure spring
10 sheath
11 closure of the pole core 8
12 flange
13 connection ring
14 O-ring
15 bobbin
16 coil winding
17 plastic body
18 connection plug
19 sealing disk
20 valve housing
21 O-ring
CRS common rail system
HP high-pressure pump
HPV high-pressure control valve
Inj injector
KB fuel tank
M1 electric motor of the high-pressure pump HP
M2 electric motor of the low-pressure pump NP
NP low-pressure pump
L1 high-pressure line
L2 conveyance line
L3 pressure release line
R high-pressure accumulator
VNC slide valve
VNO ball seat valve
VÜ mechanic pressure valve The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A common rail system for an internal combustion engine of a vehicle, comprising:

a high-pressure pump, which supplies fuel impinged with high pressure to a high-pressure accumulator, from which the fuel is fed via at least one injection valve to the internal combustion engine, a low-pressure pump to convey fuel from a fuel tank via a conveyor line to the high-pressure pump, a flow control valve as an electromagnetic switching valve, which is arranged in the conveyor line to control the quantity of fuel fed from the high-pressure pump to the high-pressure accumulator, wherein the flow control valve is embodied as a ball seat valve with a valve seat and a valve ball and an inlet opening connected to a low-pressure pump and an outlet opening connected to a high-pressure pump, which valve is open in the un-electrified state, wherein the ball seat valve comprises a pole core having a control cone for adjusting the magnetic force-stroke characteristic and an anchor embodied with a decentralized bore, which connects the bore of the pole core with a valve chamber at the side of the ball valve, and the pole core comprises a central bore to accept an adjustable pressure spring, with at one end the pressure spring being supported at the anchor and at the other end being supported at a closure part of the pole core, closing the bore at a side of the pole core pointing away from the anchor.

2. The common rail system of claim 1, wherein the ball seat valve is embodied such that in the electrified state of the ball seat valve, by the low-pressure pump applying pressure, the valve ball contacts the valve seat, hereby closing the inlet opening.

3. The common rail system of claim 2, wherein the ball seat valve is embodied with a pre-stressed spring valve such that in order to open the inlet opening the valve tappet, in the un-electrified state of the ball seat valve, is in an effective connection lifting the valve ball off its valve seat.

4. The common rail system of claim 3, wherein the ball valve comprises an anchor, which can be displaced in reference to the pole core, which centrally accepts the valve tappet.

* * * * *